US005832736A

United States Patent [19]

Yoshioka et al.

[11] Patent Number: 5,832,736

[45] Date of Patent: Nov. 10, 1998

[54] DISK HEAT EXCHANGER , AND A REFRIGERATION SYSTEM INCLUDING THE SAME

[75] Inventors: Masuo Yoshioka; Hiromoto Ohta; Tsuyoshi Maruyama, all of Nagano, Japan

[73] Assignee: Orion Machinery Co., Ltd., Nagano-ken, Japan

[21] Appl. No.: 780,285

[22] Filed: Jan. 8, 1997

[30] Foreign Application Priority Data

Jan. 16, 1996 [JP] Japan ..... 8-023279
Feb. 13, 1996 [JP] Japan ..... 8-050828

[51] Int. Cl.[6] ..... F28F 3/08; F25B 43/00

[52] U.S. Cl. ..... 62/225; 62/503; 165/167

[58] Field of Search ..... 165/165, 167; 62/225, 503

[56] References Cited

U.S. PATENT DOCUMENTS 1,325,637 12/1919 Harrison ..... 165/167
1,874,054 8/1932 Levinsen ..... 165/167
2,405,256 8/1946 Jack et al. ..... 165/167
3,240,268 3/1966 Armes ..... 165/167
4,002,201 1/1977 Donaldson ..... 165/167

*Primary Examiner*—William E. Wayner
*Attorney, Agent, or Firm*—Morrison Law Firm

[57] ABSTRACT

A counterflow heat exchanger has a pair of disklike end plates between which there are disposed a multiplicity of disklike heat transfer walls. The heat transfer walls have peripheral flanges which are fluid-tightly joined to each other to provide spaces between the walls. There are a first and a second pair of spaced openings defined through each heat transfer wall for the passage of a first and a second fluid respectively therethrough. Each heat transfer wall is additionally fluid-tightly joined to an adjacent heat transfer wall on one side thereof at their edges bounding the first pairs of openings, and to another adjacent heat transfer wall on another side thereof at their edges bounding the second pairs of openings, so that two sets of flow paths for the two fluids are formed alternately by and between the heat transfer walls. The two pairs of openings in each heat transfer wall are situated adjacent the peripheral flange thereof for uniform fluid distribution throughout each flow path. There is also disclosed herein a refrigeration system employing the heat exchanger of the foregoing construction as a refrigerant vaporizer.

10 Claims, 5 Drawing Sheets

DISK HEAT EXCHANGER , AND A REFRIGERATION SYSTEM INCLUDING THE SAME

BACKGROUND OF THE INVENTION

This invention relates to heat exchangers, to counterflow heat exchangers, and, more specifically, to improvements in heat exchangers of the type having a stack of spaced plates to define therebetween two alternating sets of flow paths for two fluids of different temperatures. The invention is also specifically directed to a refrigeration system incorporating the improved heat exchanger.

The plate type heat exchanger has been known and used extensively which comprises a stack of heat transfer plates of rectangular shape held together by tie rods between a pair of end plates. Each plate has two pairs of spaced openings defined therethrough for the passage of two fluids of different temperatures. Two different kinds of gaskets are positioned between the heat transfer plates in order to form two alternating sets of flow paths for the two fluids by and between the heat transfer plates.

In operation one fluid is directed into the device through an entrance port in one end plate, made to flow through one of one pair of openings in each heat transfer plate, then up through one set of flow paths between the heat transfer plates, then through the other of that one pair of openings in each plate, and leaves the device through an exit port in the same, or other, end plate. The other fluid is directed into the exchanger through another entrance port in either end plate, made to flow through one of the other pair of openings in each heat transfer plate, then down through the other set of flow paths between the heat transfer plates, then through the other of that other pair of openings in each plate, and leaves the device through another exit port in the same, or other, end plate. Heat exchange between the two fluids takes place as they flow counter to each other through the two alternating sets of flow paths between the stacked plates.

Admittedly, the plate type heat exchanger of the foregoing construction and operation possesses some marked advantages. Its capacity is readily variable by changing the number of the heat transfer plates in use, these being not permanently secured to one another but merely held together by tie rods between the end plates. For the same reason, moreover, the heat transfer plates can be thoroughly cleaned as required, which advantage makes the device admirably well suited for handling fluids that are easy to precipitate on the plates, or those which must be kept free from germs or other impurities.

Offsetting these advantages has been the very high pressure loss (difference between incoming and outgoing fluid pressures) per unit flow length of the plate heat exchanger in comparison with other types, due obviously to the narrow flow paths between the heat transfer plates. This weakness has made it difficult to increase the size of the device. Additionally, in the case where gaskets are used between the plates, limitations have been imposed on fluid temperatures and pressures.

Attempts have been made to overcome these drawbacks, as by enclosing the plates in a pressure-tight shell, or by brazing the plates together with the consequent elimination of the gaskets. Although these known measures have proved to serve their intended purposes in their own ways, no satisfactory suggestions seem to have yet been proposed as to how to drastically lessen the pressure losses of conventional plate heat exchangers without sacrificing their merits.

The instant applicants have also made numeral trial-and-error attempts to eliminate the noted drawbacks before completing this invention. One such attempt was to make longer the shorter dimension of each rectangular heat transfer plate, with the longer dimension unchanged, that is, to make each plate closer and closer to a square, with a view to an increase in heat transfer area.

It has been discovered as a result that pressure loss increases as the heat transfer plates become more and more square in shape, particularly with regard to a fluid flowing from an opening adjacent the bottom edge of each plate to an opening adjacent the top edge thereof. As the flow was thus impeded, precipitation or sedimentation of solids became more liable to occur, particularly in the neighborhoods of the entrance openings, ultimately resulting in clogging and hence in an increase in pressure loss. Square shaped plates proved to be no solution.

There have also been problems left unsolved with heat exchangers included in refrigeration systems. A typical refrigeration system now under consideration is a closed circuit comprised of a refrigerant compressor, condenser, heat exchanger, and liquid separator. The heat exchanger is used for heat exchange between the refrigerant and another fluid such as water or air to be cooled. Coupled to this heat exchanger via a conduit, the separator separates the liquid component from the incoming refrigerant vapor, for subsequent vaporization either by the natural heat of the surrounding atmosphere or by a heater attached to the separator vessel.

Also included in the typical known refrigeration system is a flow control valve disposed just upstream of the heat exchanger for controlling the refrigerant flow rate so as to keep constant the degree of refrigerant superheating. This flow rate control necessitates accurate measurement of the refrigerant temperature at or adjacent the exit of the exchanger. Conventionally, toward this end, what is known as a temperature sensing pressure bulb has been attached to the refrigerant conduit between exchanger and separator and enveloped by heat insulating material. A pressure signal proportional with the refrigerant temperature has been sent from the bulb to the flow control valve via a capillary tube.

A first objection to the conventional refrigeration system concerns the refrigerant conduit from the exchanger to the separator. The coupling of the conduit to the separator vessel in particular, which is of pressure-proof construction, has been troublesome and time-consuming. Another objection is the indirect measurement of the refrigerant temperature by the sensor bulb affixed to the conduit. Errors in temperature measurement have been almost unavoidable according to how the sensor bulb is mounted. The surface of the refrigerant conduit has had to be carefully machined, and the sensor bulb skillfully mounted, for optimum heat transfer contact.

SUMMARY OF THE INVENTION

The present invention has it among its objects to improve the known plate heat exchanger for smaller pressure loss, greater adaptability to various sizes and handling capacities, and less deposition or precipitation of solids on the heat transfer surfaces.

Another object of the invention is to provide a refrigeration system incorporating the improved heat exchanger, such that the system requires less installation space than heretofore, and the refrigerant temperature is measurable far more accurately than heretofore for correct control of the refrigerant flow rate, demanding no special skill for mounting the temperature sensor.

According to the invention, stated in brief, a heat exchanger is provided which comprises a plurality or multiplicity of heat transfer walls of substantially disklike shape peripherally fluid-tightly joined in stacked and spaced relationship to each other. A first and a second pair of spaced openings are defined through each heat transfer wall for the passage of a first and a second fluid respectively therethrough, the first and the second pairs of openings in all the heat transfer walls being aligned. Each heat transfer wall is additionally fluid-tightly joined to an adjacent heat transfer wall on one side thereof at their edges bounding the first pairs of openings, and to another adjacent heat transfer wall on another side thereof at their edges bounding the second pairs of openings, whereby two sets of flow paths for the two fluids are formed alternately by and between the heat transfer walls. Also included are means for the inflow and outflow of the first fluid into and from the first pairs of openings through one set of flow paths between the heat transfer walls, and for the inflow and outflow of the second fluid into and from the second pairs of openings through the other set of flow paths between the heat transfer walls.

The heat transfer walls may be flat, but corrugated walls, particularly those with herringbone corrugations, are preferred for the increased surface area. Either way, it is essential that the heat transfer walls, as well as a pair of end plates normally used on both sides of them, be more or less circular in shape, so that these walls will be hereinafter referred to as the heat transfer disks or simply as disks. Flowing into a flow path between any two neighboring disks, a fluid will encounter no such straight edges or corners as those of the prior art rectangular plates that obstruct its flow, but will be guided by the annular disk edges to flow smoothly and uniformly toward the exit opening of that flow path.

Preferably, in order to assure even smoother fluid flow, an annular flange may be formed along the periphery of each heat transfer disk, and the two pairs of openings in each disk may be situated adjacent, but somewhat spaced from, the peripheral flange of that disk. It is also preferable that the two pairs of openings be each substantially elliptical in shape, elongated along the disk periphery. The flange of each disk will then serve to more uniformly distribute the fluid throughout the flow path.

Pressure loss will thus be greatly mitigated, and the accumulation of solids on the heat transfer surfaces will also be reduced to a minimum. Experiment has proved that these advantageous results become more pronounced when the heat transfer plates are circular, rather than elliptical, in shape; in other words, when the plates are of elliptic shape, the closer to one is the ratio between the longer and shorter dimensions of the ellipse, the better are the results.

As has been set forth in the foregoing summary of the invention, each heat transfer disk is fluid-tightly joined, as by brazing, to another disk on one side thereof at their edges bounding the first pairs of openings, and to still another disk on the other side thereof at their edges bounding the second pairs of openings, without use of intervening gaskets or seals. The brazing areas can be so small that the fluid flows are unimpeded or, rather, expedited by the absence of additional sealing means. Although the brazing of the disks makes it impossible to disassemble the device for cleaning, this is more than amply offset by far less accumulation of solids, making the device well suited for handling high purity fluids, those which must be protected against infestation with germs, or those which require high pressure heat exchange.

As is apparent from the foregoing, the heat exchanger according to the present invention is generally cylindrical in shape. This fact, combined with the brazing or like one-piece joining of all its constituent disks, makes the device far more pressure-proof than the prior art plate heat changers of comparable design.

Thus the heat exchanger according to the invention lends itself to use in a refrigeration system, for heat exchange between a refrigerant and another fluid such as water or air to be cooled. The heat exchanger in this application comprises a first end disk with a refrigerant entrance port defined therethrough, a second end disk having a refrigerant exit port defined therethrough, and a plurality of heat transfer disks of the foregoing construction aligned between the two end disks. The first pairs of spaced openings in the heat transfer disks are aligned to provide a refrigerant entrance channel in direct communication with the refrigerant entrance port in the first disk, and a refrigerant exit channel in communication with the refrigerant exit port in the second end plate. The second pairs of spaced openings in the heat transfer disks, likewise aligned between the end plates, are for the entrance and exit of another fluid for heat exchange with the refrigerant, which heat exchange takes place as the two fluids flow counter to each other through the two alternating sets of flow paths between the heat transfer disks. Another component, which is of particular significance as far as the instant invention is concerned, is a liquid separator having a pressure-tight vessel joined directly to the second end plate of the heat exchanger for admitting the refrigerant through the refrigerant exit port and for separating a liquid component from the refrigerant.

By virtue of its high operating efficiency the disk heat exchanger according to the invention permits easy reduction in size without sacrificing its handling capacity, so that a liquid separator of matching size may be attached directly to one of the end plates of the heat exchanger to provide a compact exchanger-separator combination. No conduit is necessary between exchanger and separator, unlike the case heretofore, so that the exchanger-separator combination is less expensive in construction and easier of assemblage than the conventional separate units.

It might be contemplated that the liquid separator could be coupled directly to the conventional rectangular plate heat exchanger. It should be recalled, however, that the separator, which must be pressure-proof, is normally tubular in shape because it gains the most mechanical strength when fabricated in that shape. The disk heat exchanger according to the invention is generally cylindrical in shape, so that the separator can be compactly coupled to the heat exchanger in axial alignment and in matching relative sizes.

As an additional advantage the second end plate of the heat exchanger can be used as a part of the pressure-tight separator vessel, with the refrigerant exit port in the exchanger end plate made to open directly to the interior of the separator vessel. The exchanger-separator combination will then become even more simplified and lightweight in construction and easier of manufacture.

A further feature of the refrigeration system resides in a heat sensor disposed in the refrigerant exit channel of the heat exchanger for sensing the temperature of the refrigerant and for providing a signal indicative of the refrigerant temperature. This signal is supplied to a flow control valve disposed upstream of the heat exchanger, enabling the same to control the flow rate of the refrigerant introduced into the heat exchanger so as to keep constant the temperature of the refrigerant that has completed heat exchange.

It should be appreciated that the temperature sensor makes direct contact with the refrigerant going to leave the heat exchanger, as distinguished from the prior art in which the heat sensor was mounted on the outside of the refrigerant conduit between exchanger and separator. No preparatory measures or skill is required for inserting the temperature sensor in the refrigerant exit channel. The temperature sensor will nevertheless measure the refrigerant temperature more accurately than heretofore. The temperature sensor may not necessarily be positioned exactly in the refrigerant exit channel but thereabout, for example, at or adjacent the refrigerant exit port in the exchanger end plate.

The above and other features and advantages of this invention and the manner of realizing them will become more apparent, and the invention itself will best be understood, from a study of the following description and appended claims, with reference had to the attached drawings showing some preferable embodiments of the present invention.

DESCRIPTION OF THE PREFERRED EMBODIMENTS

Figure 1:
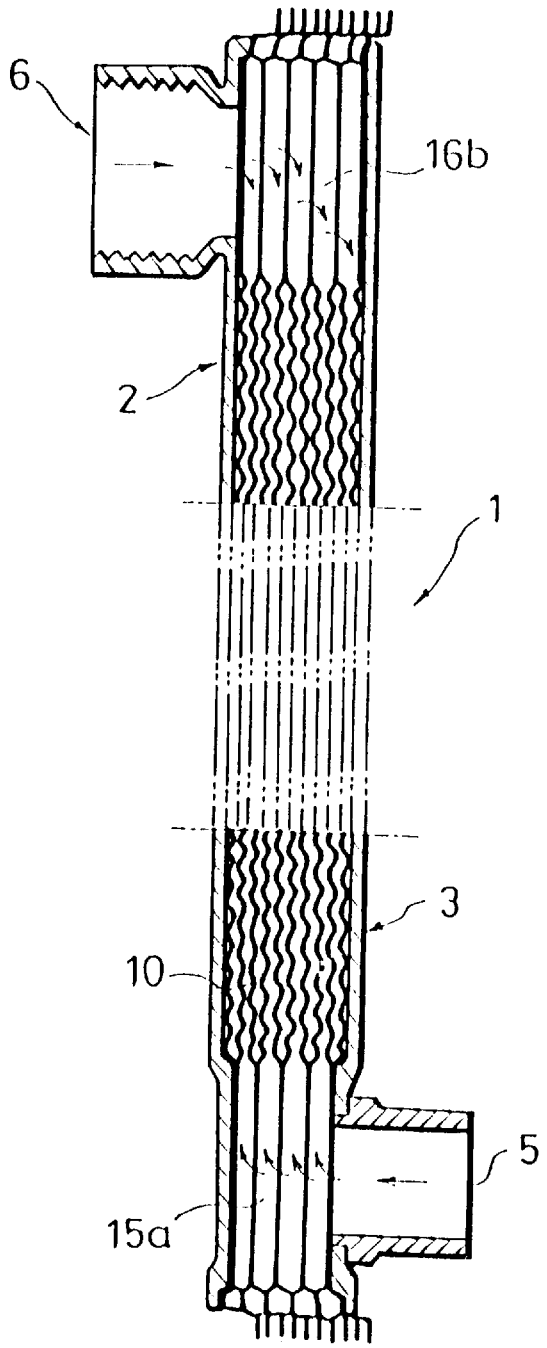
FIG. 1 is an axial section through the disk heat exchanger constructed in accordance with the novel concepts of the present invention.

The present invention will now be described more specifically and as embodied by way of example in the counterflow heat exchanger illustrated in FIG. 1 and therein generally designated 1. The exemplified heat exchanger 1 comprises a pair of end plates 2 and 3 between which are sandwiched a plurality or multiplicity of heat transfer walls 10 of substantially disklike shape and heat conducting material in stacked, spaced relationship to one another. The modifier "substantially" is used here because the walls need not be exactly circular but may be, for example, elliptic, although clear distinction should be made between the heat transfer disks of the instant invention and the prior art heat transfer plates of rectangular shape.

Figure 2:
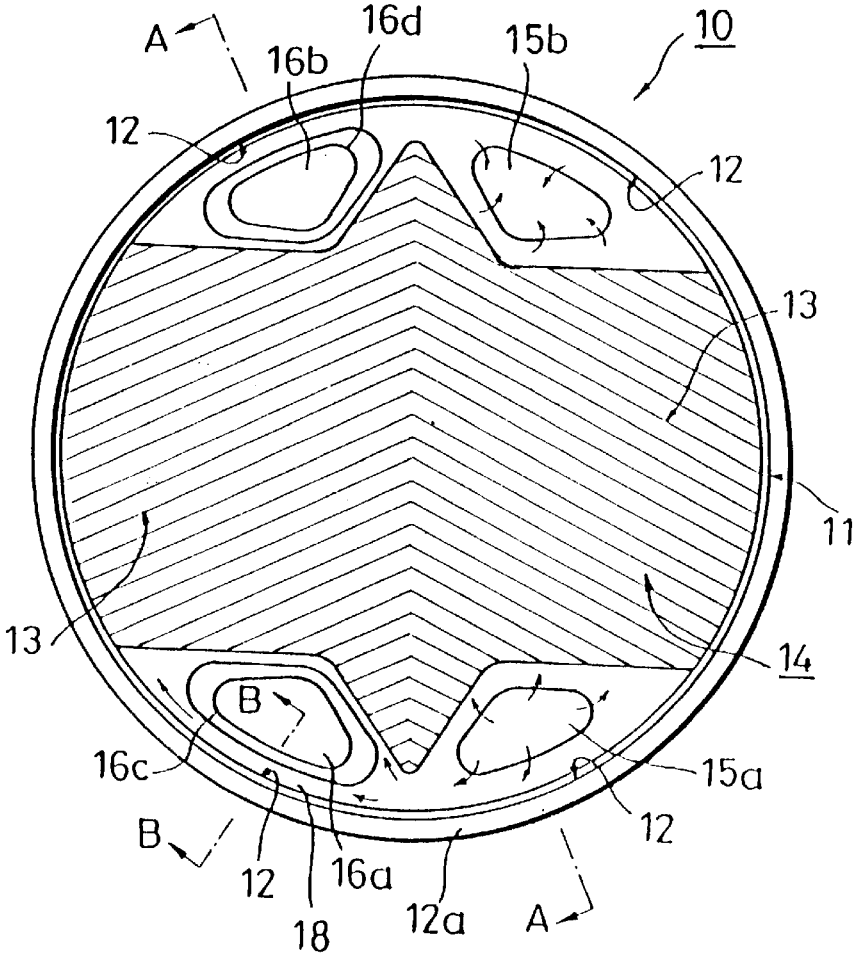
FIG. 2 is an elevation on a somewhat reduced scale of one of many heat transfer walls or disks of the heat exchanger, the line A—A in this figure showing the plane along which the section of FIG. 1 is taken.
Figure 3:
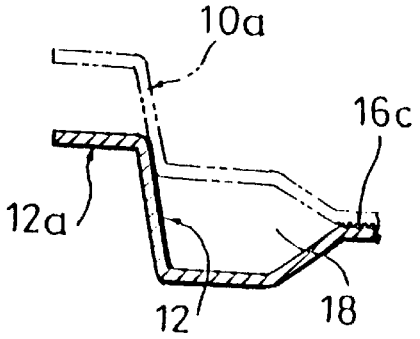
FIG. 3 is a fragmentary section taken along the line B—B in FIG. 2 and showing in particular the peripheral flange of each heat transfer disk, the view being shown on a greater scale than FIG. 1 or 2.

As better illustrated in FIG. 2 and on an enlarged scale in FIG. 3, each heat transfer disk 10 has an annular flange 12 on its periphery and an annular rim 12*a* further extending radially outwardly from the flange. The flange 12 gradually increases in diameter as it extends from the disk 10 toward the rim 12*a*, for ease in stacking the disks in axial alignment. A series of corrugations 13 are formed, as by pressing, in herringbone pattern on the majority of each disk surface, leaving a pair of flat surface portions in diametrically opposite positions on both sides of the corrugations. A heat conducting surface 14 is thus formed on each side of the disk 10.

Defined through the flat surface portions of each heat transfer disk 10 are a first pair of spaced openings 15*a* and 15*b* for the entrance and exit of one fluid, and a second pair of spaced openings 16*a* and 16*b* for the entrance and exit of another fluid. Each generally elliptic in shape, the openings extend along the peripheral flange of each disk with spacings 18, FIGS. 2 and 3, therebetween. These spacings serve as fluid passageways designed for smoother fluid flow from the entrance to the exit openings, as will be later discussed in more detail. Further the two pairs of openings 15*a*, 15*b*, 16*a* and 16*b* are all so shaped, sized, and arranged that they are of bilateral symmetry with respect to two orthogonal axes contained in the plane of the disk and intersecting at the geometric center of the disk.

All the heat transfer disks 10 are stacked in axial alignment, with the two pairs of openings 15*a*, 15*b*, 16*a* and 16*b* all in alignment along the disk axis, with the flange 12 of each disk partly engaged in the flange of the next disk as in FIG. 3, and with the herringbone corrugations 13 of the disks oriented alternately in opposite directions. The orientation of the herringbone corrugations in two opposite directions does not require the preparations of two different kinds of disks as the two pairs of openings in each disk are of bilateral symmetry with respect to the noted two orthogonal axes. The interengaging flanges 12 of all the disks 10 are integrally joined together, as by brazing, with the consequent creation of spaces between the disks.

Additionally, each heat transfer disk 10 is brazed or otherwise joined to one adjacent disk on one side thereof at their edges bounding the first pair of openings 15*a* and 15*b*, and to the other adjacent disk on the other side thereof at their edges 16*c* and 16*d* bounding the second pair of openings 16*a* and 16*b*. Consequently, as will be understood from a closer study of FIG. 1, two sets of flow paths for two fluids are formed alternately by and between the heat transfer disks.

For integrally joining the heat transfer disks 10 as above, these disks may themselves be fabricated from brazing sheets and heated in a furnace. Alternatively, the disks with a brazing filler metal therebetween may be heated in a vacuum furnace. Any of these and other joining methods may be employed according to the material of the disks or to the intended applications of the heat exchanger.

Two sets of fluid inlets and outlets must be formed in either or both of the end plates 2 and 3. Let 15*a* in FIG. 2 be the entrance opening, and 15*b* the exit opening, for one fluid. As indicated in FIG. 1, a fluid entrance port 5 may then be formed in the end plate 3, for example, so as to open directly to the entrance openings 15*a* of the disks. Flowing into these entrance openings 15*a* from the entrance port 5, the fluid will be distributed into the first set of flow paths between the disks, rejoin at the exit openings 15*b*, and flow out the exit port, not shown, formed in either end plate.

For operation in counterflow mode, an entrance port 6 for a second fluid may be formed in the end plate 2 so as to open directly to the openings 16*b* in the disks 10. The second fluid will be distributed from these openings 16*b* into the second set of flow paths between the disks. Heat exchange between the two fluids will take place mostly as they flow counter to each other through the two alternating sets of flow paths between the disks. The second fluid will rejoin at the other openings 16*a* in the disks and leave the device through the exit port, not shown, formed in either end plate.

Particular attention is invited to the flow modes of the fluids being distributed from the entrance openings 15*a* or 16*b* into the two alternating sets of flow paths between the disks. As indicated by the arrows over the entrance opening 15*a* in FIG. 2, the fluid will come smoothly streaming out in all directions around the opening. Even those streams which are directed away from the exit opening 15*b* will be guided by the peripheral flange 12 of the disk to eventually move toward the exit opening.

The left half, as viewed in FIG. 2, of the flow path between any two neighboring disks 10 might seem very easy to give rise to pressure loss, the left half being farther away from both entrance and exit openings than is the right half. However, by virtue of the arcuate passageway 18 between the opening 16*a* and the disk flange 12, the fluid will not stagnate at the left half of the flow path but will flow far more smoothly toward the exit opening 15*b* than if no such arcuate passageways were present or if rectangular plates were used in place of the disks. At the exit opening 15*b*, too, the disk flange 12 itself and the arcuate passageways between the openings 15*b* and 16*b* and the disk flange will guide some of the fluid, helping the fluid to stream smoothly into the exit opening from all directions, as indicated also by the arrows in FIG. 2.

Figure 4:
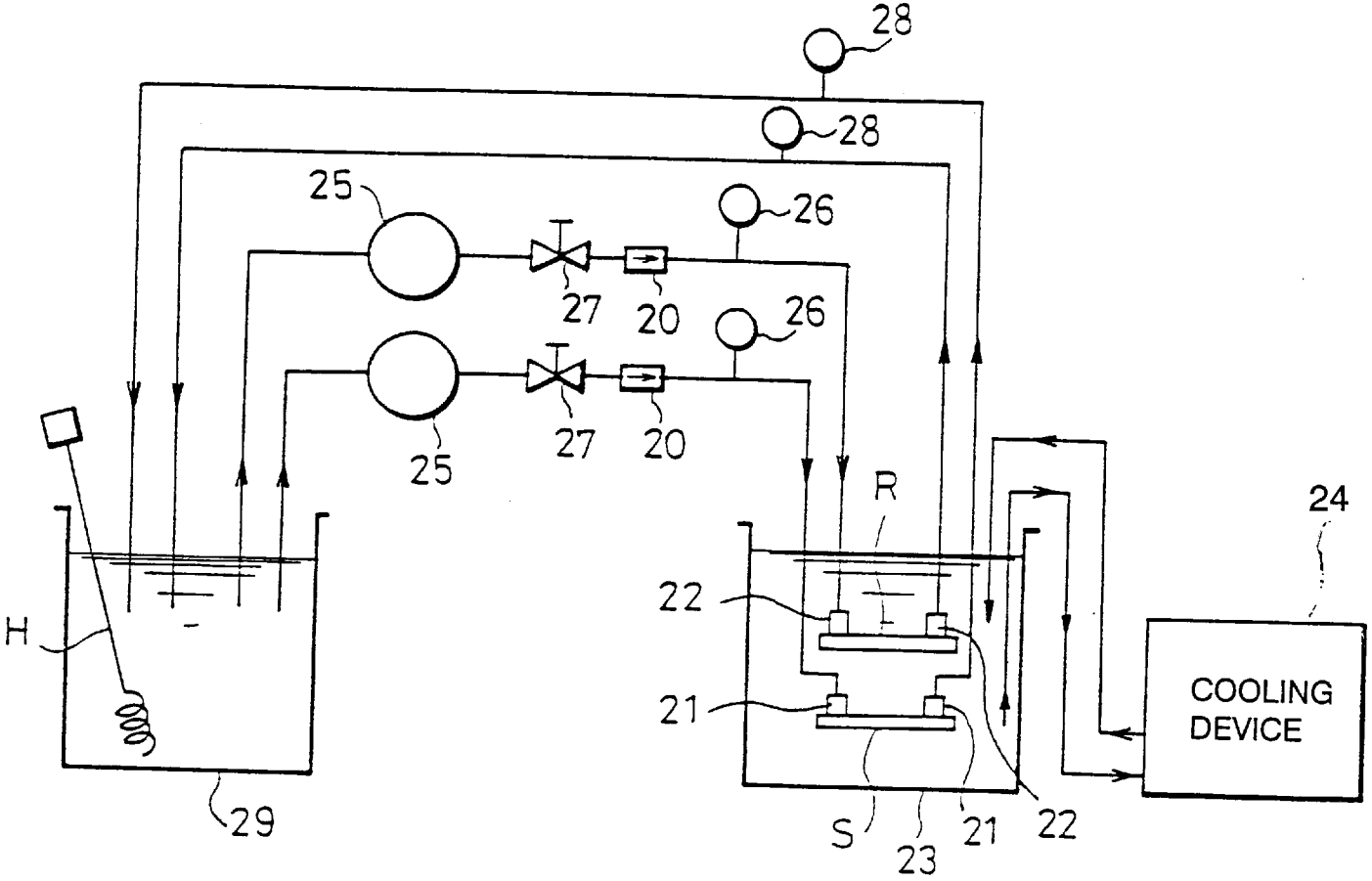
FIG. 4 is a diagram explanatory of a setup for comparing the pressure losses of two test heat exchangers, one constructed according to the present invention, and the other according to the prior art.

FIG. 4 illustrates the setup used to compare the performance of the disk heat exchanger of this invention with that of the prior art rectangular plate heat exchanger. There were prepared two test devices S and R The device S was of the prior art construction having rectangular heat transfer plates. The other device R was of the FIGS. 1–3 construction according to the invention. Each device was provided with a pair of nozzles 21 and 22 of the same diameter for the inflow and outflow of one fluid. Both devices were also alike in having their disks or plates fabricated from aluminum, in having herringbone corrugations alternately oriented in opposite directions, and in having the same number of disks or plates of the same surface area.

Both test devices R and S were submerged in water within a vessel 23 which was held at 5° C. by a cooling device 24. The entrance nozzles of the test devices were communicated with a vessel 29 containing a saturated alum solution, via respective conduits each having a pump 25, a cock 27, an entrance pressure meter 26, and a flowmeter 20. The exit nozzles of the test devices were also communicated with the vessel 29 via respective conduits each having an exit pressure meter 28. The alum solution was held at 60° C. by a heater H. The alum solution was pumped through the test devices at rates of 1.5, 2.5 and 3.5 liters per minute, and the pressure losses (differences between the readings of the entrance and exit pressure meters 26 and 28) of both devices were ascertained at time intervals of 10 to 20 minutes at each flow rate.

Figure 5:
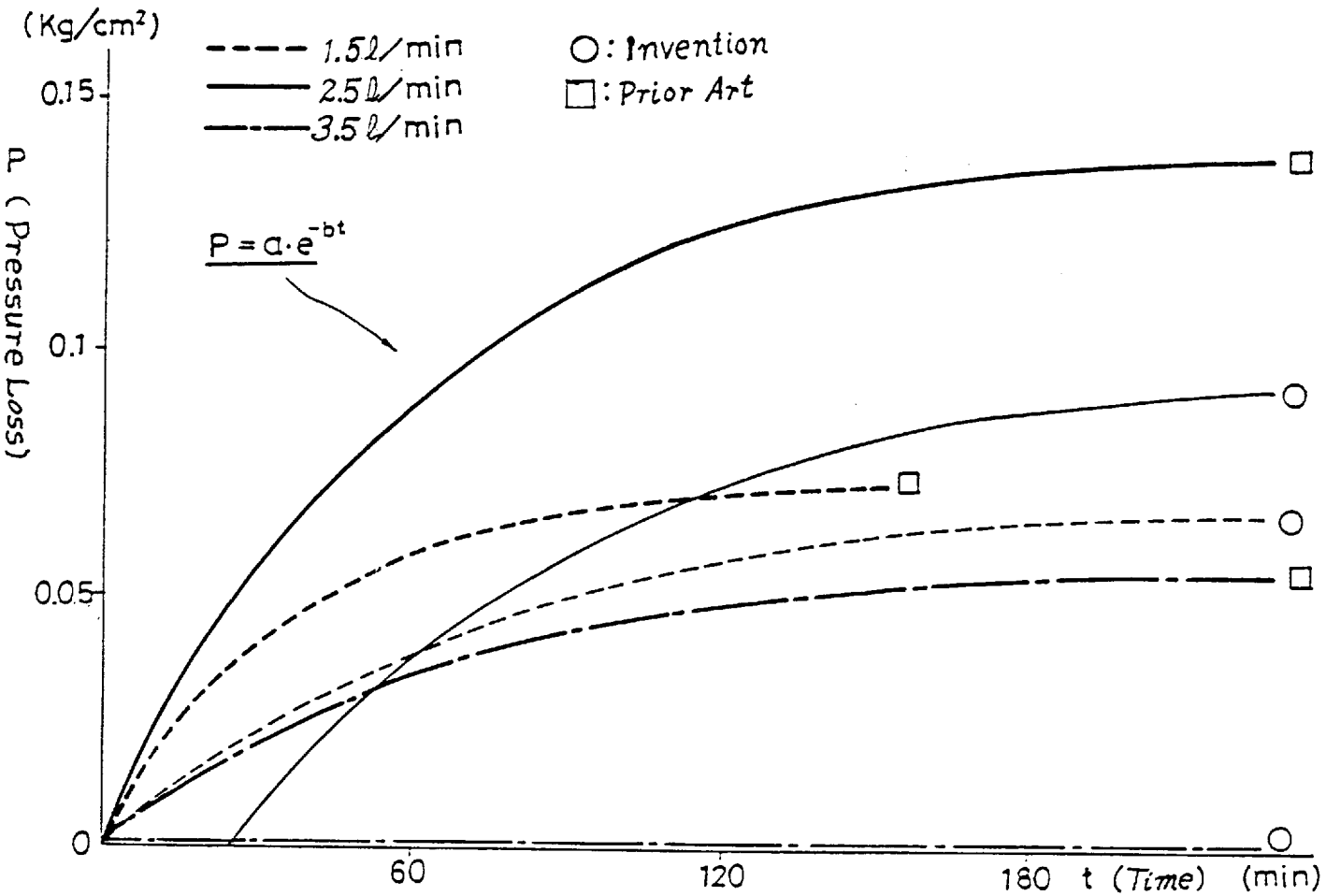
FIG. 5 is a graphic demonstration of the comparative pressure loss tests conducted by use of the FIG. 4 setup.

The results are graphically represented in FIG. 5. It is clear from this graph that the test device according to the invention is far less in pressure loss than the prior art device at each flow rate. Particularly, at 3.5 liters per minute, and obviously at higher flow rates, too, the inventive device suffers little or no pressure loss even after three hours of continued operation.

From the pressure loss curves of FIG. 5 there can be obtained the empirical formula, $P=a\cdot e^{-bt}$, where P is the pressure loss, a and b constants, t time, and e the base of an exponential function. From this formula the time constant T can be computed by the equation T=l/b for each curve in order to provide a quantitative measure of the immunity of each device from clogging at each selected flow rate. The results, tabulated below, indicate the superiority of the inventive disk heat exchanger over the prior art.

TABLE

| | Second Form | | |
|---|---|---|---|
| | Time Constant (Min.) | | |
| | 1.5 1/min. | 2.5 1/min. | 3.5 1/min. |
| Plate | 37 | 74 | 74 |
| Disk | 79 | 94 | ∞ |

Figure 6:
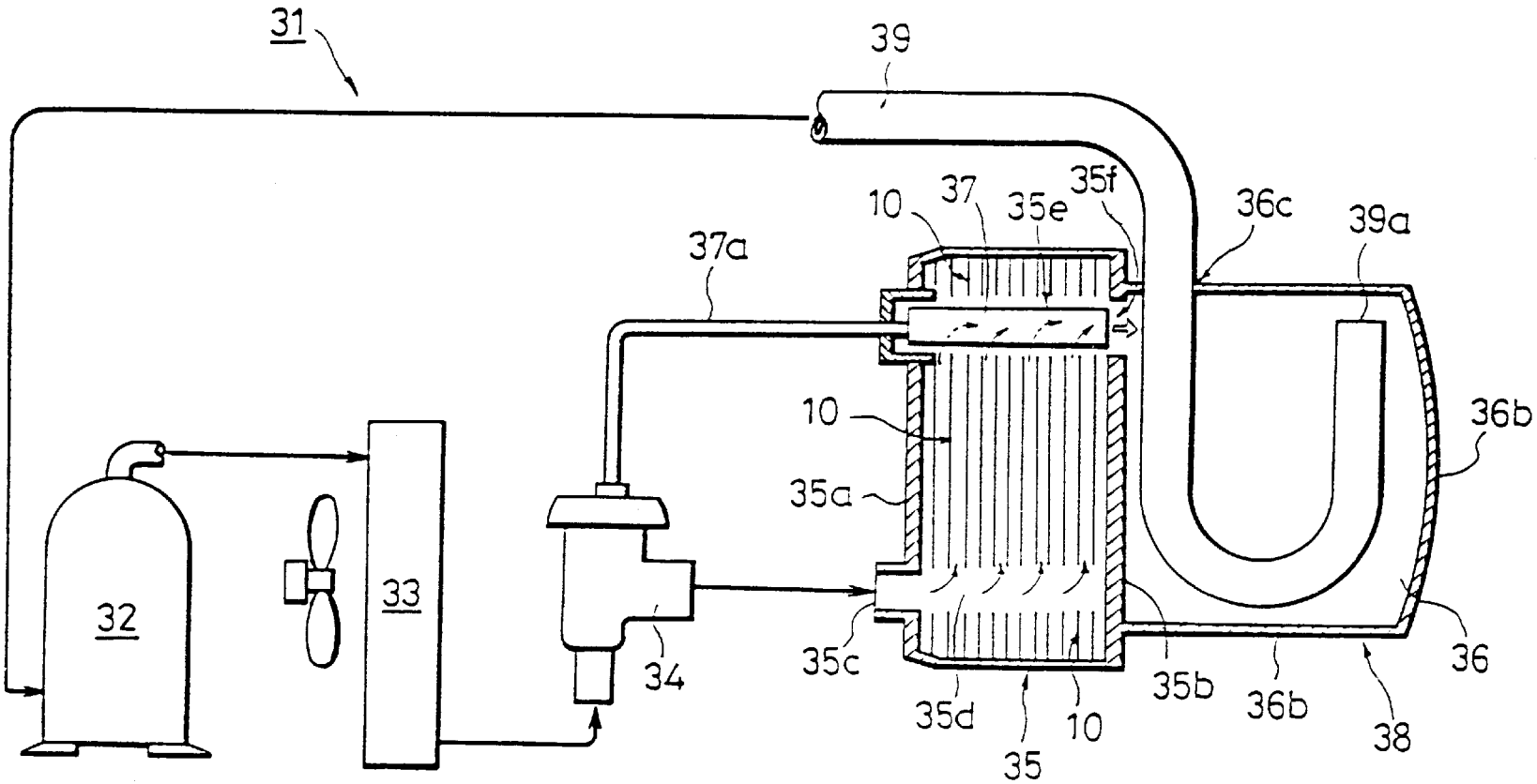
FIG. 6 is a diagrammatic illustration of a refrigeration system employing the FIGS. 1–3 heat exchanger.

In FIG. 6 is diagrammatically illustrated the disk heat exchanger of the present invention used for refrigerant vaporization in a refrigeration system 31. Essentially, the refrigeration system 31 is a closed circuit for refrigerant recirculation, comprising a compressor 32, condenser 33, flow control valve 34, heat exchanger 35, and liquid separator 38, all of which intercommunicate via a conduit system to form the refrigerant recirculation circuit. Constructed in accordance with the present invention, the heat exchanger 35 functions in this particular application to cool water or air by a refrigerant, with the consequent vaporization of the refrigerant. The heat exchanger 35 is herein diagrammatically shown to comprise a stack of heat transfer disks 10 between a first end disk 35*a* and a second end disk 35*b*. It is understood that the heat exchanger 35 is analogous in further details of construction with that shown in FIGS. 1–3.

Of the two pairs of openings 15*a*, 15*b*, 16*a* and 16*b*, FIG. 2, formed in each heat transfer disk of the heat exchanger, the openings 15*a*, for example, of all the disks are aligned to form a refrigerant entrance channel 35*d*, FIG. 6, to which is open a refrigerant entrance port 35*c* in the first end disk 35*a*. The openings 15*b* of all the heat transfer disks are likewise aligned to form a refrigerant exit channel 35*e* which is open to a refrigerant exit port 35*f* in the second end disk 35*b*.

Although not seen in FIG. 6, the other pair of openings 16*a* and 16*b* in the heat transfer disks 10 are understood to be likewise aligned to provide an entrance channel and an exit channel, respectively, for a fluid such as water or air to be cooled by heat exchange with the refrigerant. The water or air is to be introduced into the heat exchanger through an entrance port, not shown, formed in the first end disk 35*a*, and to be withdrawn therefrom through an exit port, also not shown, also formed in the first end disk.

At 37 is seen a temperature sensor shown wholly disposed in the refrigerant exit channel 35*e* of the heat exchanger for sensing the temperature of the refrigerant there. The temperature sensor 37 communicates with the flow control valve 34, connected just upstream of the heat exchanger, by way of a conduit 37*a* for supplying thereto a pressure signal indicative of the refrigerant temperature.

The liquid separator 38 has a pressure-tight vessel 36 which is formed in the shape of a tubular body 36*b* with a closed end 36*a* in one piece therewith. The other end of the separator vessel 36 is closed by the second end disk 35*b* as the separator vessel is pressure-tightly attached to this end disk in axial alignment with the heat exchanger 35. The refrigerant exit port 35*f* of the heat exchanger is therefore open to the interior of the separator vessel 36 for discharging the vaporized refrigerant into the vessel, in which the refrigerant is to be separated from its liquid component.

Pressure-tightly extending through the highest part 36*c* of the separator vessel 36, a suction conduit 39 communicates the separator with the compressor 32. The refrigerant entrance end 39*a* of the conduit 39 is held high within the separator vessel 36 for drawing in only the vaporized refrigerant.

Heat exchange between the refrigerant and the water or air takes place as, directed into the entrance channel 35*d* of the heat exchanger 35 through the entrance port 35*c*, the refrigerant streams up through the flow paths between the heat transfer disks 10, such flow paths being disposed as aforesaid alternately with those through which flows the water or air. Then the refrigerant will flow into the exit channel 35*e*, intimately surrounding the heat sensor 37, and thence into the separator 38 via the exit port 35*f*. Being positioned for direct contact with the refrigerant that has just completed heat exchange, the heat sensor 37 will accurately sense the refrigerant temperature to enable highly sensitive control of the flow rate control by the valve 34.

Notwithstanding the foregoing detailed disclosure, it is not desired that the present invention be limited by the exact showing of the drawings or the description thereof. A variety of changes may be made to conform to design preferences or to the requirements of each specific application of the invention without departure from the spirit of the invention as expressed in the attached claims.

What is claimed is:

1. A heat exchanger for use with two fluids of different temperatures, comprising:

(a) a plurality of heat transfer walls of substantially disklike shape peripherally fluid-tightly joined in stacked and spaced relationship to each other;

(b) there being a first pair of spaced openings defined through each heat transfer wall for the passage of a first fluid therethrough, the first pairs of openings in all the heat transfer walls being aligned;

(c) there being a second pair of spaced openings defined through each heat transfer wall for the passage of a second fluid therethrough, the second pairs of openings in all the heat transfer walls being aligned;

(d) each heat transfer wall being additionally fluid-tightly joined to an adjacent heat transfer wall on one side thereof at their edges bounding the first pairs of openings, and to another adjacent heat transfer wall on another side thereof at their edges bounding the second pairs of openings, whereby two sets of flow paths for the two fluids are formed alternately by and between the heat transfer walls; and (e) means for the inflow and outflow of the first fluid into and from the first pairs of openings through one set of flow paths between the heat transfer walls, and for the inflow and outflow of the second fluid into and from the second pairs of openings through the other set of flow paths between the heat transfer walls;

(f) each heat transfer wall having an annular flange extending along a periphery thereof, the flanges of neighboring heat transfer walls being directly joined to each other so as to provide the flow paths between the heat transfer walls;

(g) the first and the second pairs of openings in each heat transfer wall being situated adjacent the peripheral flange of that heat transfer wall, with the flanges serving to uniformly distribute the fluids throughout the flow paths between the heat transfer walls.

2. The heat exchanger of claim 1 wherein the two pairs of openings in each heat transfer wall are each substantially elliptical in shape, elongated along peripheral flange of each heat transfer wall.

3. The heat exchanger of claim 1 wherein each heat transfer wall is formed to include corrugations.

4. The heat exchanger of claim 3 wherein the heat transfer walls are disposed with their herringbone patterns alternately oriented in opposite directions.

5. The heat exchanger of claim 4 wherein each heat transfer wall is substantially planar in shape, and wherein the first and the second pairs of openings are disposed in bilateral symmetry with respect to two orthogonal axes contained in the plane of each heat transfer wall.

6. The heat exchanger of claim 3 in which the corrugations are formed in a herringbone pattern.

7. In a refrigeration system, in combination:

(A) a heat exchanger for vaporizing a refrigerant by heat exchange with another fluid, the heat exchanger comprising:

(a) a first end plate having a refrigerant entrance port defined therethrough (b) a second end plate of substantially disklike shape having a refrigerant exit port defined therethrough;

(c) a plurality of heat transfer walls of substantially disklike shape aligned between the first and the second end plates and peripherally fluid-tightly joined in stacked and spaced relationship to each other;

(d) there being a first pair of spaced openings defined through each heat transfer wall for the passage of a refrigerant therethrough, the first pairs of openings in all the heat transfer walls being aligned to provide a refrigerant entrance channel in communication with the refrigerant entrance port in the first end plate, and a refrigerant exit channel in communication with the refrigerant exit port in the second end plate;

(e) there being a second pair of spaced openings defined through each heat transfer wall for the passage therethrough of a second fluid for heat exchange with the refrigerant; and (f) each heat transfer wall being additionally fluid-tightly joined to an adjacent heat transfer wall on one side thereof at their edges bounding the first pairs of openings, and to another adjacent heat transfer wall on another side thereof at their edges bounding the second pairs of openings, whereby two sets of flow paths for the refrigerant and the second fluid are formed alternately by and between the heat transfer walls for heat exchange between the two fluids; and (B) a liquid separator having a pressure-tight vessel of substantially tubular shape joined end to end to the second end plate of the heat exchanger for admitting the refrigerant through the refrigerant exit port and for separating a liquid component from the refrigerant.

8. The refrigeration system of claim 7 further comprising:

(a) a heat sensor disposed adjacent the refrigerant exit channel of the heat exchanger for sensing the temperature of the refrigerant and for providing a signal indicative of the refrigerant temperature; and (b) a flow control valve for controlling the flow rate of the refrigerant introduced into the heat exchanger in response to the signal from the heat sensor.

9. The refrigeration system of claim 7 wherein the pressure-tight vessel of the liquid separator has a closed end and an open end, the open end of the vessel being closed by the second end plate of the heat exchanger.

10. A counterflow heat exchanger for use with two fluids of different temperatures, comprising:

(a) a pair of end plates having means for the separate inflow and outflow of the fluids;

(b) a plurality of heat transfer walls of substantially disklike shape aligned between the pair of end plates, the heat transfer walls having peripheral flanges of annular shape which are fluid-tightly joined to each other to provide spaces between the heat transfer walls;

(c) there being a first and a second pair of spaced openings defined through each heat transfer wall for the passage of a first and a second fluid respectively therethrough, each heat transfer wall being additionally fluid-tightly joined to an adjacent heat transfer wall on one side thereof at their edges bounding the first pairs of openings, and to another adjacent heat transfer wall on another side thereof at their edges bounding the second pairs of openings, whereby two sets of flow paths for the two fluids are formed alternately by and between the heat transfer walls;

(d) the two pairs of openings in each heat transfer wall being situated adjacent the peripheral flange thereof, whereby a fluid on entering a flow path between any two neighboring heat transfer walls from one of either pair of openings is uniformly distributed throughout the flow path by the peripheral flange of that flow path.

* * * * *